United States Patent [19]

Bondoc et al.

[11] Patent Number: 4,825,616

[45] Date of Patent: May 2, 1989

[54] ROOFING SHINGLE

[75] Inventors: Alfredo A. Bondoc, South Bound Brook; Stanley P. Frankoski, West Milford; Frederick W. Sieling, Bound Brook, all of N.J.

[73] Assignee: GAF Corporation, Wayne, N.J.

[21] Appl. No.: 184,528

[22] Filed: Apr. 21, 1988

[51] Int. Cl.[4] ..... E04D 1/12

[52] U.S. Cl. ..... 52/518; 52/747

[58] Field of Search ..... 52/518, 557, 555, 747, 52/539

[56] References Cited

U.S. PATENT DOCUMENTS 2,378,027 6/1945 Murray ..... 52/557

OTHER PUBLICATIONS

Sweet's Catalog File by McGraw Hill, 1985; 7.7/EL pp. 2,4,5; and 7.7 Geo, p. 4.

*Primary Examiner*—John E. Murtagh

*Attorney, Agent, or Firm*—Marilyn J. Maue; Joshua J. Ward

[57] ABSTRACT

The invention relates to a reroofing shingle having a 7.5 inch or a 15 inch vertical exposure, a 2 inch lap portion and an overall height of n(exposure)+2 inches where n has a value of 1 when the reroofing shingle is an undivided strip and a value of 2 when the reroofing shingle comprises a sheet having spaced tabs in the butt portion thereof. The invention also relates to the installation of the present tabbed reroofing shingles over standard asphaltic roofing in a manner such that the lower tab edges of each successive course of reroofing shingle is alined with the top of the spaces between tabs of the preceding reroofing course and allows for a 7.5 inch or 15 inch exposure between courses.

13 Claims, 4 Drawing Sheets

ROOFING SHINGLE

BACKGROUND OF THE INVENTION

Generally strip roofing shingles, be they tabbed or undivided shingle sheets or tabbed composite shingles having a narrow sheet laminated beneath the tabbed portion, are supplied in two sizes, namely English and Metric sheet size. The English strip shingle measures 12 inches high by 36 inches long and has a 5 inch exposure between applied courses. Eighty shingle pieces of this dimension are required to cover 100 square feet of roof deck. The Metric sheet measures 13.25 inches high by 39.375 inches long and has a 5.625 inch exposure between applied courses, requiring 65 shingles to cover the same surface area of roof deck.

When reroofing, problems occur due to incompatibility between the Metric and English dimensions. The most common problem arises in the use of the Metric shingle which is less expensively installed for reroof over shingles of English dimension. During application, the roofer has no point of reference to insure horizontal alignment of the reroofing shingle courses and must either rely on his judgement or provide reference lines by measuring and striking chalk lines at intervals up the original roof courses. Also, because of the lack of registry between the English and Metric sizes and the shape conformance of current standard fiber glass based asphalt products, roofing Metric over English shingles, or visa versa, results in objectionable distortions on the surface of the finished roof which imparts unsightly irregularity. Further, the nature of the distortions can affect the ultimate weather-proofing and life of the completed roof assembly. Additionally, nailing of Metric over English or vice versa leads to problems of breakage and tearing where the nailing of the overlay shingles recurrently align and penetrate in a cantilevered area of the underlay formed by the overlapping of underlay courses. To minimize the above problems, it has been necessary for the manufacturer to maintain separate inventories of English and Metric shingles for reroofing purposes.

Difficulties also arise when reroofing with Metric over Metric or English over English since the manufactured batches of shingles are subject to some irregularity in height. A slight difference, e.g. 1/16 inch, which may occur between the original and the reroofing shingle, becomes significant after many courses of reroofing material have been laid since such alignment problems are cumulative in the overall installation. Additionally, the many courses which must be laid with conventional overlapping and nailing, considerably increases the weight of the roofing and presents many areas for failure around the nails which penetrate the roof deck, conventionally at a distance of 10 inches apart along a horizontal line for each course. Such alignment of courses, and overlapping and nailing of each course requires considerable time and precision for proper installation. In certain instances the roof deck is not sufficiently reinforced to take additional weight over 1 or 2 roofing assemblies. In such cases, at least one underlay roofing must be removed before reroofing. Accordingly, there has been a long felt need for reroofing shingles which eliminate difficulties in alignment, provide adequate weatherproofed coverage, decrease occasions for tearing at nail sites and which minimize weight load, areas of deformation and time consuming installation operations.

It is an object of this invention to eliminate certain of the above problems and to minimize others.

Another object is to provide a reroofing shingle of specific dimension common to courses of English and Metric size shingles which obviates errors in alignment, provides adequate weatherproofed coverage, minimizes area of deformation, provides a lighter reroof covering and greatly reduces time and expense of installation.

THE INVENTION

In accordance with this invention there is provided a roofing shingle having a 7.5 inch or a 15 inch exposure and an overall height of n(exposure) +2 inches allowance for an overlapping area between courses where n has a value of 1 when the shingle is an undivided strip and a value of 2 when the shingle comprises a sheet having 7.5 inch or 15 inch exposed spaced tabs. Consequently, the overall height of the present shingle is 9.5 inches for a 7.5 inch exposure of an undivided roofing shingle strip ; 17 inches for a 15 inch exposure of an undivided roofing shingle strip; 17 inches for a 7.5 inch exposure of a tabbed shingle sheet or 32 inches for a 15 inch exposure of a tabbed shingle sheet. Although all height dimensions can be slightly increased without jeopardizing shingle integrity, such extension provides no additional benefit and represents a waste of material. Also, the increased height adds considerably to the weight bearing on the roof deck.

The length of the present shingle is indeterminate since the reroofing material can be supplied as a strip of uniform length, or as a continuous roll, e.g. on a spool, to be let out and cut at the length desired which may be the length of the roof. Uniform lengths of roofing shingle are generally supplied in about 30 to about 45 inch lengths commensurate with the manufactured length of English or Metric shingles and are more easily handled.

The tabbed reroofing shingles of the present invention having not more than 1 inch spacing between tabs are preferred; although those having up to 2 inch spacing between tabs are also suitable. These shingles have an undivided headlap portion of approximately 9.5 inches or 17 inches and a butt or tabbed portion of 7.5 inches or 15 inches and can comprise a single tabbed sheet or a composite arrangement. When tab spacing exceeds 2 inches it is recommended that a composite shingle arrangement be employed. Illustrative of shingles having this composite tabbed design are those described in U.S. Pat. No. 3,921,358. Such composites have a separate continuous narrow sheet or strip laminated to the undersurface of the tabbed butt portion and about 1 inch of the adjoining headlap portion to seal the spaces between tabs and insure weatherability. Such a composite shingle has many aesthetic benefits but is more expensive to manufacture.

Because of the unique dimensions of the present reroofing shingles and the registry of their 7.5 inch or 15 inch exposed portions with the 5 inch exposed tabs of the English shingle and the 5.625 inch exposed tabs of the Metric shingle, it is found that nesting problems are completely eliminated. More specifically with the present shingle having a 7.5 inch exposure, the exposed reroofing areas of two successive courses covers three of the English exposed portions while the headlap horizontal edge of the second reroofing course abuts the lower tab edges of the 5th course of English size underlay, subsequently every other course of reroofing will have the headlap horizontal edge abut a tab edge of the English size underlay. This nesting provides for easy automatic alignment and eliminates the need for chalk marking or imperfect judgement on the part of the roofer. Such automatic nesting also allows the roofer, by slight adjustment, to compensate for any misalignment or imperfections which may exist in the original roofing courses and thereby provides a more aesthetic finished product. Additionally, since only two courses of reroofing require nailing and overlapping, instead of nailing and overlapping three of the English size shingles, significant savings in time, labor and material is realized while providing a lighter, more eye pleasing reroofed covering. This savings is considerable since it requires 80 English size 36 inch length shingles to cover every 100 square feet of roof as compared to only 56 of the present reroofing shingles of 36 inch length and 7.5 inch exposure to cover the same area. Furthermore, the covering with fewer shingle pieces reduces wastage and provides fewer joints where water can penetrate. Savings in material is also realized by the need for fewer overlapping areas during installation. Further, because of the lighter reroofing weight, the underlay courses generally need not be removed before resurfacing in order to avoid exceeding the maximum weight load allowance of an average roof deck, thus eliminating refuse collection and disposal problems. Also, the present shingles characterized by their increased height and coverage of underlay shingles, require fewer nails to secure them over a given area, thus minimizing sites of failure and improving weatherability. Still further, their registry with both English and Metric shingles provides nailing sites which avoid the cantilevered areas of the underlay and thereby minimize crumbling and displacement of the underlay base. Significant economical advantages are also realized by the use of the present shingles since they eliminate the need for maintaining separate reroofing English and Metric size inventories.

Similarly, it is found that the present 7.5 inch exposed reroofing areas of three successive courses covers four of the Metric exposed portions while the headlap horizontal edge of the third reroofing course abuts the lower tab edges of the 6th course of a Metric size underlay to obtain all of the advantages discussed above in connection with the English size shingle. In the case of the Metric size, only 65 shingles are required to cover a 100 square foot area; however, only 49 of the identical length reroofing shingles described herein of 7.5 inch exposure are needed to cover the same area. A similar registry with English and Metric size shingles exists for the present shingles having a 15 inch exposure and the same benefits described above are obtained. In this case, the exposed reroofing areas of 2 successive courses covers 6 courses of the English exposed portions while the reroofing headlap horizontal edge of the first course above the starting strip abuts the lower tab edges of the 6th course of English size underlay. Conversely, the exposed reroofing areas of 3 successive courses covers 8 courses of the Metric exposed portions while the reroofing headlap horizontal edge of the first course above the starting strip abuts the lower tab edges of the 10th course of the Metric size underlay.

Thus, the present reroofing shingle provides registry with both English and Metric shingle sizes and satisfies the reroofing needs of practically all commercial asphaltic roofing shingles. Because of this registry, a better seal is provided by affixing the upper horizontal margin of the reroofing shingle in alignment with the lower horizontal margin of the original shingle.

As referred to above, the present shingle of the aforesaid critical dimensions may be an undivided strip, a tabbed strip or a length of composite shingle having a continuous headlap portion and a tabbed butt portion with undivided continuous strip laminated to the undersurface of the butt portion so as to effectively fill the spaced areas between tabs. The present shingle can be constructed of a reinforcing substrate, saturated and/or coated with asphaltic material or other conventional and suitable waterproofing materials, optionally carrying on its exposed surface standard decorative and weathering granules.

In general, for covering pre-existing roofing with the undivided roofing shingle of this invention, course upon course with a 7.5 inch or 15 inch exposure is successively laid down, nailed and sealed with a 2 inch lap until reroofing is completed. However, when using a preferred tabbed reroofing shingle, a preliminary strip having a height of 9.5 inches or 17 inches to underlay the 7.5 inch or 15 inch exposed tabs and allowance for a 2 inch lap is initially affixed to the roof deck as a starting strip, either by nailing or by adhesion thereto. After the starting strip is in place, course upon course of the present shingles are laid in a manner such that the tabs of each course abut the upper space between the tabs of the preceding course. The courses are then nailed firmly in place in a conventional manner. For a more aesthetic appearance, the spaces between the tabs are usually staggered in the placement of successive courses to provide at least 4" joint side lap. For example, a suitable arrangement is described in U.S. Pat. No. 3,921,358.

Having thus generally described the present invention, reference is now had to the drawings.

BRIEF DESCRIPTION OF THE DRAWINGS

FIGS. 1–3 are drawn to scale on a section taken from the eave toward the ridge of a standard roof. More specifically, FIG. 1 is a top plan view illustrating the lack of registry in the placement of courses using commercial 5.625 inch exposure Metric strip shingles, hatched area 2, to cover underlying roofing of conventional 5 inch exposure English strip shingles, designated by non-hatched area 3. As shown, the upper horizontal edges of the Metric reroofing courses fail to nest at any pattern of regularity with the underlying horizontal edges of the English shingle courses, thus providing an unfinished, untidy appearance more aptly shown in FIG. 4. Also, it is apparent that nailing the Metric shingles along their upper horizontal edges encounters many areas where cantilevered joints of the original English courses occur.

FIG. 2 is a top plan view illustrating precise nesting in the placement of every second course using the present 7.5 inch exposure reroofing shingles, cross hatched area 6, to cover underlying roofing of English strip shingle courses identified by non-cross hatched area 7. As shown at points 5, the upper horizontal edges of every alternate course of the present shingle abuts the lower horizontal edges of the underlying English shingle courses, providing a regular repeat in the overall configuration of the reroofing surface and eliminating the need for application guide lines. Also, it is apparent that nailing of the reroofing shingles along their upper horizontal edge avoids any area of underlay where cantilevered joints occur.

FIG. 3 is a top plan view illustrating precise nesting in the placement of every third course using the present 7.5 inch exposure reroofing shingles, designated by cross hatched area 10, to cover underlying roofing of Metric strip shingle courses, identified by non-cross hatched area 12. As shown at points 9, the upper horizontal edges of every third course of the present shingle abuts the lower horizontal edges of the underlying Metric shingle courses, thus providing the desired guide to alignment and minimizing ridging and other distortions more aptly shown in side view sections by FIGS. 4–6. As in FIG. 2, nailing sites of the reroofing shingle avoids cantilevered areas of the underlay.

Figure 1:
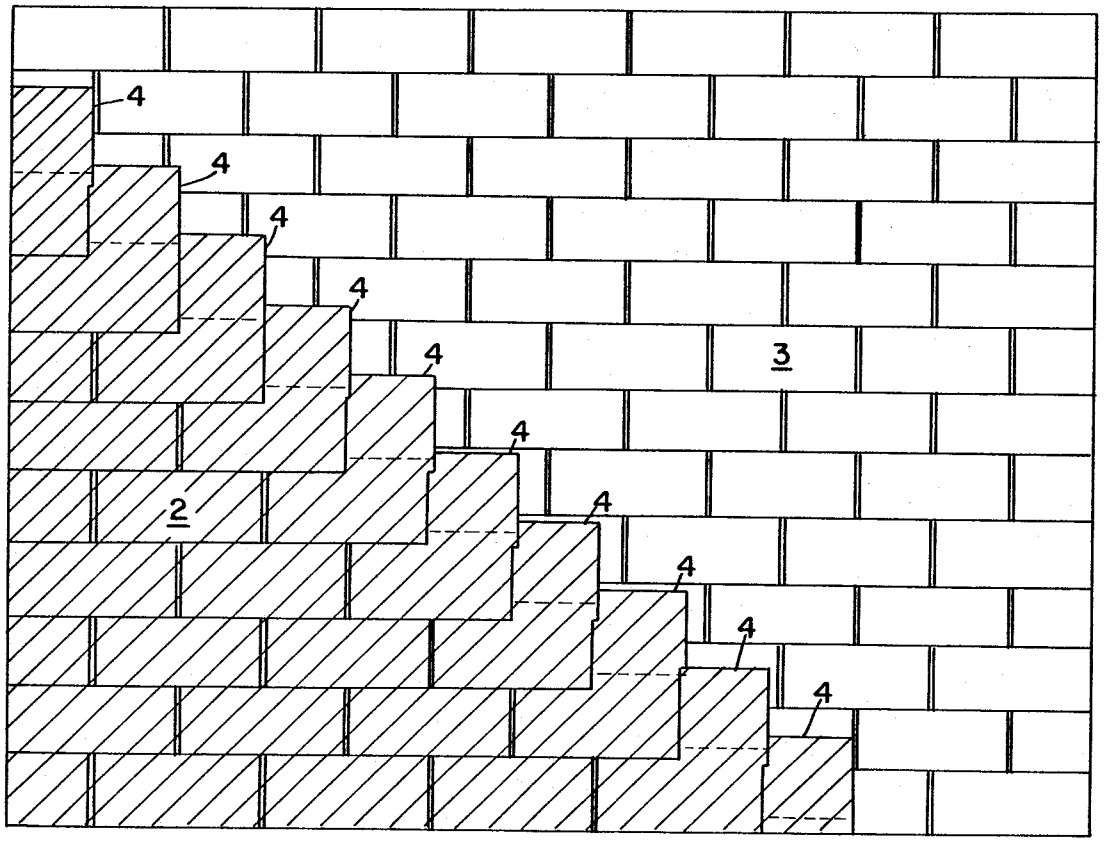
FIG. 1 PRIOR ART
FIGS. 1 and 4 do not represent the invention but are presented for comparative purposes to illustrate the problems associated with reroofing with Metric size shingles over English size shingles.
Figure 2:
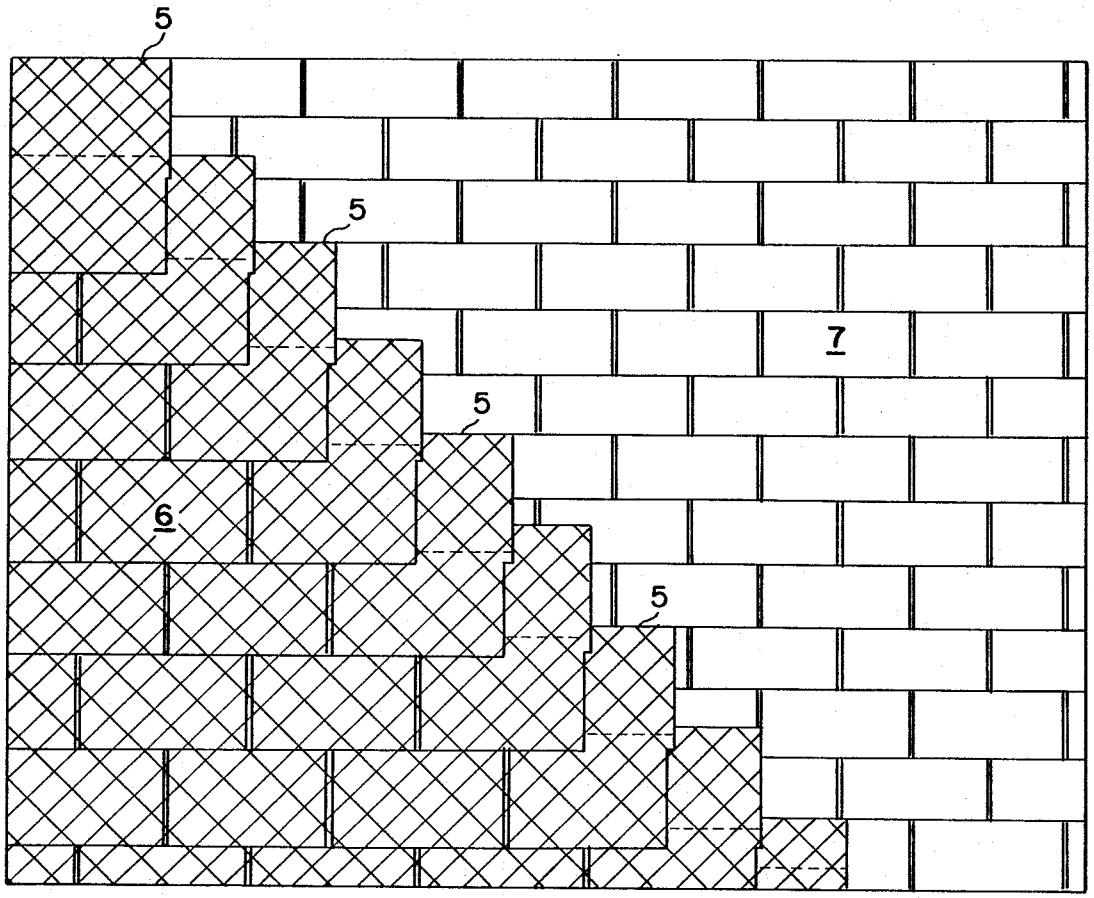
FIGS. 2,3,5 and 6 show to plan or side sectional views of the invention of reroofing with underlays of English or Metric shingles.
Figure 3:
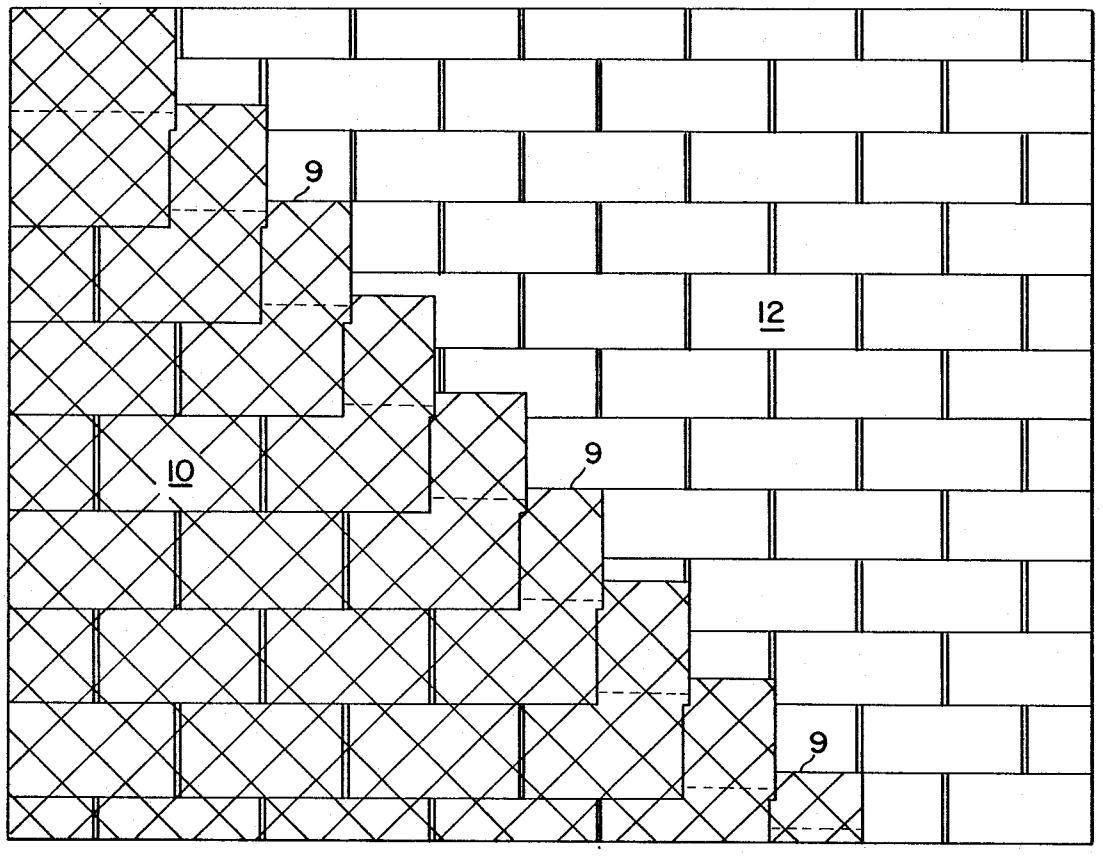

The solid rectangular areas in portions 2,6 and 10 of FIGS. 1, 2 and 3 respectively, indicate the pattern of self sealing adhesive located in the vicinity of the overlap courses of shingles.

Figure 4:
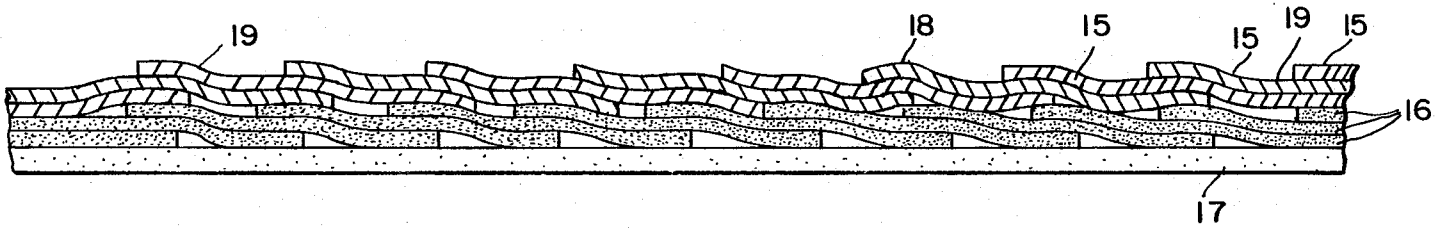
FIG. 4 PRIOR ART

FIG. 4 is a side sectional view of 5.625 inch exposure Metric strip shingles, hatched area 15, installed over 5 inch exposure English strip shingles in area 16 on dotted roof deck area 17. As shown, at the sixth course of the overlay a major non conforming ridge occurs at point 18. Also, a pronounced declination occurs at point 19 due to the non-registry of the Metric shingle courses with English shingle courses. The random or repetative areas of declination and the underlying spaces where the reroofing shingles bridge butt edges of successive English shingle courses increases occasion for failure due to breakage and water seepage. A common problem encountered in this arrangement is that of moisture entrapped in the spaces below the reroofing courses which leads to blistering and premature ageing. The pronounced ridge forming at the sixth course on the reroofing surface occasions lack of adequate sealing and is subject to curl and rupture.

Figure 5:
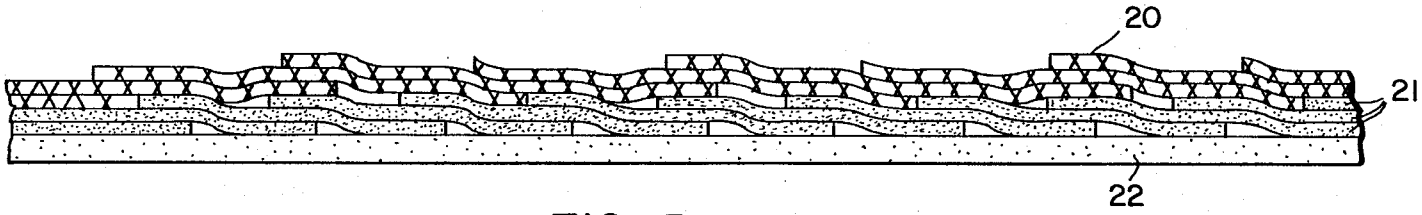

FIG. 5 is a side sectional view of the present 7.5 inch exposure reroofing shingles cross hatched area 20, mounted over conventional English dimension shingles 21 covering dotted roof deck area 22. As shown, due to the abuttment of every second course of the present shingle with the lower horizontal edge of the underlying English shingle course, the reroofing overlay displays a regular overlapped pattern which eliminates random unsightly ridges and valleys and which significantly decreases the number of air pockets which give rise to water seepage and breakage.

Figure 6:
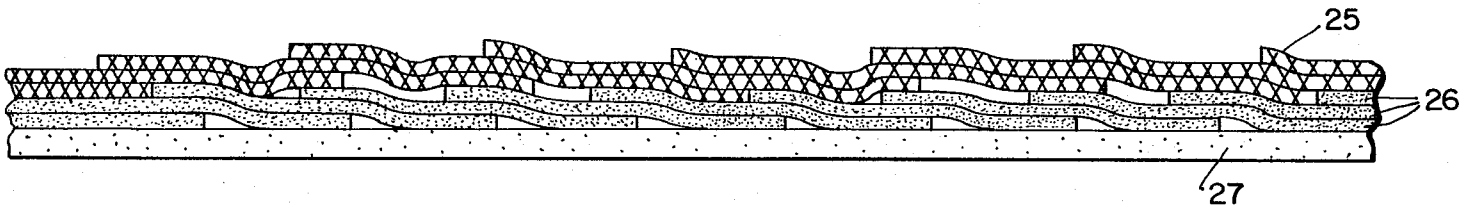

FIG. 6 is a side sectional view of the present 7.5 inch exposure reroofing shingles, cross hatched area 25, mounted over Metric shingles 26 covering dotted roof deck area 27. As shown, due to abuttment of every third course of the present shingles with the lower horizontal edge of the underlying Metric shingle course, the reroofing overlay displays a substantially uniform overlapped pattern which eliminates periodically or randomly occurring ridges and valleys and which significantly reduces the number of air pockets leading to water seepage and shingle failure.

Due to the critical height dimension of the present shingles and precise nesting, minor placement alterations can be made along each course to compensate for any imperfections or misalignment in the underlying roofing and such alterations can be made without sacrifice to weatherability.

It will be obvious to those skilled in the art that the present shingles can also be used as new roofing installed directly on a roof deck and because of its larger dimension provides fewer sites for air pockets and water seepage.

What is claimed is:

1. In the process for reroofing over English or Metric size shingles, the improvement which comprises: reroofing over said English or Metric size shingle with a reroofing shingle having a 7.5 inch or 15 inch vertical exposure and an overall height which is the sum of n(vertical exposure)+2 inches wherein n has a value of one when said reroofing shingle is an undivided strip and n has a value of two when said reroofing shingle is a tabbed sheet whereby every alternate course of said reroofing shingle nests with the third course of English shingles and every third course of reroofing shingle nests with the fourth course of Metric shingle.

2. The process of claim 1 wherein said shingle is tabbed and the height of said shingle is 17 inches.

3. The process of claim 2 wherein said shingle is a composite having a sheet composed of a 9.5 inch undivided headlap portion and a tabbed butt portion and an undivided strip underlying the butt portion of the sheet to fill spaces between said tabs.

4. The process of claim 3 wherein at least some of the spaces between tabs in the butt portion of said sheet of said shingle exceed 2 inches.

5. The process of claim 1 wherein said shingle is an undivided strip and the height of said shingle is 9.5 inches.

6. The process of claim 1 wherein said shingle a length of between about 30 and about 45 inches.

7. The process of claim 2 wherein said shingle supplied as continuous roll for cutting at any desired length.

8. The process of claim 1 which comprises reroofing over English size shingles.

9. The process of claim 1 which comprises reroofing over Metric size shingles.

10. A roof deck surfaced with English or Metric asphalt shingles and overlaid with shingles having a 7.5 inch or 15 inch vertical exposure and an overall height which is the sum of n(vertical exposure)+2 inches wherein n has a value of one, when said reroofing shingle is an undivided strip and n has a value of two, when said reroofing shingle is a tabbed sheet, wherein every alternate course of overlaid shingles nests with every third course of English size shingles and every third course of overlaid shingle nests with every fourth course of Metric size shingles.

11. A process for roofing a roof deck by an improved method conducive to subsequent reroofing with English or Metric size shingles which comprises covering said deck with original shingles having a 7.5 inch or 15 inch vertical exposure and an overall height which is the sum of n(vertical exposure)+2 inches wherein n has a value of one when said original shingle is n undivided strip and n has a value of two when said original shingle is a tabbed sheet whereby said roofing is adapted for more frequent nesting with English or Metric size reroofing shingles.

12. A roof deck surfaced with original shingles having a 7.5 inch or 15 inch vertical exposure and an overall height which is the sum of n(vertical exposure)+2 inches wherein n has a value of one when said original shingle is an undivided strip and has a value of two when said original shingle is a tabbed sheet, wherein said original shingles are overlaid with English or Metric size shingles and wherein every third course of English size shingles nests with every alternate course of original shingles and every fourth course of Metric size shingles nests with every third course of original shingles.

13. A roof deck over which is installed a layer of shingles having a 7.5 inch or 15 inch vertical exposure and an overall height which is the sum of n)vertical exposure)+2 inches wherein n has a value of one when said original shingle is an undivided strip and has a value of two when said original shingle is a tabbed sheet and a separate layer of shingles having English or Metric dimensions.

* * * * *